US010095141B2

(12) United States Patent
Urabe

(10) Patent No.: US 10,095,141 B2
(45) **Date of Patent: *Oct. 9, 2018**

(54) TONER CONTAINING PARTICLES HAVING FLAKY SHAPE AND MADE OF BRIGHT PIGMENT MATERIAL

(71) Applicants: KABUSHIKI KAISHA TOSHIBA, Tokyo (JP); TOSHIBA TEC KABUSHIKI KAISHA, Tokyo (JP)

(72) Inventor: Takashi Urabe, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/477,363

(22) Filed: Apr. 3, 2017

(65) Prior Publication Data

US 2017/0205720 A1 Jul. 20, 2017

Related U.S. Application Data

(63) Continuation of application No. 14/829,722, filed on Aug. 19, 2015, now Pat. No. 9,651,884.

(30) Foreign Application Priority Data

Aug. 21, 2014 (JP) ..... 2014-168771

(51) Int. Cl.
*G03G 9/08* (2006.01)
*G03G 9/087* (2006.01)
(Continued)

(52) U.S. Cl.
CPC ..... *G03G 9/0827* (2013.01); *G03G 9/0819* (2013.01); *G03G 9/0823* (2013.01);
(Continued)

(58) Field of Classification Search
CPC ..... G03G 9/0902; G03G 9/0825
(Continued)

(56) References Cited

U.S. PATENT DOCUMENTS 9,274,447 B2 3/2016 Sawai et al.
9,651,884 B2 * 5/2017 Urabe ..... G03G 9/0902
(Continued)

FOREIGN PATENT DOCUMENTS

JP 2010-256613 11/2010
JP 2012032765 A 2/2012
(Continued)

OTHER PUBLICATIONS

Extended European Search Report dated Jan. 31, 2016, mailed in counterpart European Application No. 15181287.2, 8 pages.
(Continued)

*Primary Examiner* — Mark A Chapman
(74) *Attorney, Agent, or Firm* — Patterson & Sheridan, LLP

(57) ABSTRACT

A toner includes toner particles including particles having a flaky shape and made of bright pigment material and a binder resin coated on the surfaces of the particles. A ratio of an exposed surface area of the particles with respect to a surface area of the toner particles is greater than 0% and equal to or smaller than 20%.

20 Claims, 1 Drawing Sheet

(51) Int. Cl.
*G03G 9/09* (2006.01)
*G03G 15/08* (2006.01)

(52) U.S. Cl.
CPC ..... *G03G 9/0825* (2013.01); *G03G 9/08755* (2013.01); *G03G 9/0902* (2013.01); *G03G 9/0926* (2013.01); *G03G 15/0865* (2013.01)

(58) Field of Classification Search
USPC ..... 430/108.6
See application file for complete search history.

(56) References Cited

U.S. PATENT DOCUMENTS

| | | | |
|---|---|---|---|
| 2009/0111040 | A1 | 4/2009 | Veregin et al. |
| 2009/0220880 | A1 | 9/2009 | Moffat et al. |
| 2011/0318682 | A1 | 12/2011 | Takahashi et al. |
| 2013/0137030 | A1 | 5/2013 | Sato et al. |
| 2013/0143151 | A1 | 6/2013 | Nakashima et al. |
| 2013/0244163 | A1 | 9/2013 | Sato et al. |
| 2015/0370184 | A1 | 12/2015 | Araki et al. |

FOREIGN PATENT DOCUMENTS

| | | | |
|---|---|---|---|
| JP | 2013068817 | A | 4/2013 |
| JP | 2013072944 | A | 4/2013 |
| JP | 2013113995 | A | 6/2013 |
| JP | 2013117697 | A | 6/2013 |
| JP | 2013190552 | A | 9/2013 |

OTHER PUBLICATIONS

Japanese Office Action dated Dec. 19, 2017, filed in Japanese counterpart Application No. 2014-168771, 6 pages (with translation).

* cited by examiner

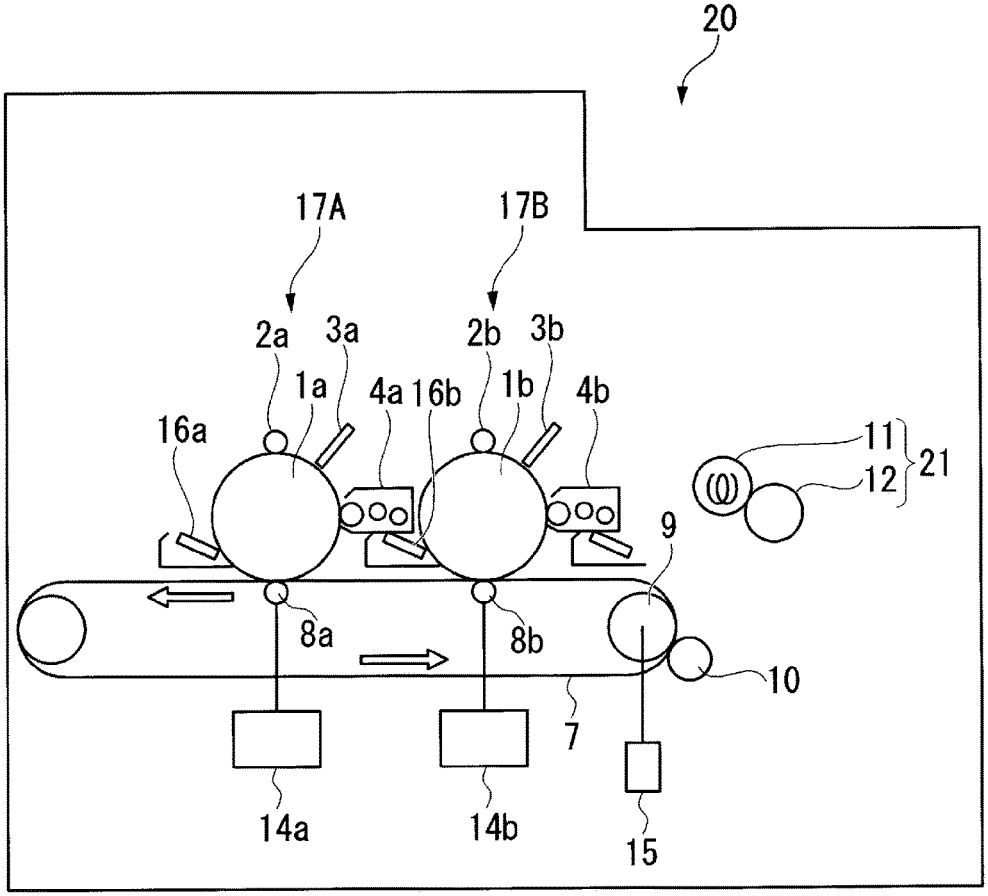
20
17A
17B
2a
3a
2b
3b
1a
4a
16b
1b
4b
16a
11
12
21
9
8a
8b
10
7
14a
14b
15

TONER CONTAINING PARTICLES HAVING FLAKY SHAPE AND MADE OF BRIGHT PIGMENT MATERIAL

CROSS-REFERENCE TO RELATED APPLICATION

This application is a continuation of U.S. patent application Ser. No. 14/829,722, filed on Aug. 19, 2015, which is based upon and claims the benefit of priority from Japanese Patent Application No. 2014-168771, filed Aug. 21, 2014, the entire contents of which are incorporated herein by reference.

FIELD

Embodiments described herein relate generally to a toner, in particular, a toner containing flaky glittering pigment particles.

BACKGROUND

A variety of coloring materials is used for image printing. One of the coloring materials includes a high-functioning toner, which is different from a conventional toner of YMCK colors. For example, one of the high-functioning toner is a toner containing bright (glittering) pigment particles, which delivers metallic luster or pearl luster as a colorant.

A particle diameter of conventional bright pigment particles is evenly large and the particle diameter thereof is approximately from 1 μm to 500 μm. In addition, the bright pigment includes a flat reflecting surface with which light reflects in a complicated manner. In general, as the particle diameter becomes large, the number of the reflecting surfaces increases and strong metallic luster or pearl luster can be obtained. Meanwhile, when the particle diameter of the bright pigment is small, it is difficult to obtain the metallic luster or pearl luster.

When the bright pigment is used for an image, viewers of the image may recognize that the image has a brilliant gloss because the viewers recognize scattering light reflected on the image. To reflect the light, it is necessary to align the reflecting surfaces of the bright pigment particles to be substantially parallel to an image surface.

One of the bright pigment particles includes a base portion and metal oxide (titanium oxide or iron oxide) coated on the surface thereof. For the base portion, mica or the like having a chemically high stability and excellent heat resistance may be used. The pearl luster is obtained by coating the surface of the base portion with metal oxide having a different refractive index from that of the base portion.

However, the toner containing the glittering pigment particles is less likely to retain a sufficient amount of electric charges required for image forming or tends to be susceptible to an environmental change. Therefore, a toner containing the glittering pigment particles that enables a more reliable image forming is demanded.

DESCRIPTION OF THE DRAWINGS

FIGURE is a side view of an image forming apparatus according to an embodiment.

DETAILED DESCRIPTION

One embodiment provides a toner, a developer, a toner cartridge, and an image forming apparatus which can obtain preferable chargeability (charge amount and stabilization thereof), which leads to an excellent image forming.

A toner of an embodiment includes toner particles including particles having a flaky shape and made of bright pigment material and a binder resin coated on the surfaces of the particles. A ratio of an exposed surface area of the particles with respect to a surface area of the toner particles is greater than 0% and equal to or smaller than 20%.

Hereinafter, the electrophotographic toner of an embodiment will be described in detail.

The electrophotographic toner of the embodiment (hereinafter, also simply referred to as "toner") contains toner particles which are obtained by coating flaky bright (glittering) pigment with a binder resin.

Hereinafter, a configuration of the toner particles will be described.

The toner particles are obtained by coating flaky bright pigment with a binder resin.

The bright (glittering) pigment consists of flaky particles. Since the particles of the bright pigment are flaky, the bright pigment is likely to have metallic luster or pearl luster.

An aspect ratio of the bright pigment (ratio of a long side and a thickness of the particle) is preferably equal to or greater than 3 and is more preferably greater than 10 and smaller than 200. When the aspect ratio of the bright pigment is equal to or greater than the preferable lower limit, the bright pigment is likely to have the metallic luster or the pearl luster. Meanwhile, when the aspect ratio thereof is equal to or smaller than the preferable upper limit, the entire bright pigment is likely to be sufficiently coated with the binder resin.

A volume average particle diameter of the bright pigment is preferably equal to or greater than 5 μm and is more preferably greater than 8 μm and smaller than 20 μm. When the volume average particle diameter of the bright pigment is equal to or greater than the preferable lower limit, brilliance of the pigment further increases.

In the present embodiment, the volume average particle diameter of the particle group can be measured using a laser-diffraction-type particle size distribution measuring device.

The material of the bright pigment is not particularly limited as long as the pigment has brilliance, and examples thereof include: metal such as aluminum, brass, bronze, nickel, stainless steel, or zinc; a flaky inorganic crystalline substance coated with metal oxide; single-crystal plate-like titanium oxide; basic carbonate; bismuth oxychloride; natural guanine; flaky glass powder; and flaky glass powder subjected to metal deposition.

Examples of the flaky inorganic crystalline substance include mica, barium sulfate, layered silicate, and silicate of layered aluminum. Examples of metal oxide of the flaky inorganic crystalline substance include titanium oxide, and iron oxide.

Among these materials, as the bright pigment, for having higher brilliance of the pigment, the flaky inorganic crystalline substance coated with metal oxide and metal powder are preferable, and the flaky inorganic crystalline substance coated with metal oxide is particularly preferable.

As the bright pigment, a mica pigment coated with metal oxide may be used. Examples of the mica pigment coated with metal oxide include ROTOSAFE 700 series, ROTOFLEX XA series, LITHOFLEX XA series, STAPA 3000 series, STAPA 2000 series, LITHOFLEX ST 01510, STANDART 4000 series, and STANDART 3000 series manufactured by ECKART; MERCK IRIODIN 100 series, IRIODIN 200 series, IRIODIN 300 series, and IRIODIN 500 series manufactured by MERCK; XIRALLIC series, COLORSTREAM series, and MIRAVAL series.

Alternatively, as the bright pigment, a pigment of aluminum flake may be used. Examples of the pigment of aluminum flake include DF-1667, DF-2750, DF-3500, DF-3622, DF-554, and DF-L-520AR; LED-1708AR and LED-2314AR; SILBERCOTE PC 0452Z, SILBERCOTE PC 1291X, SILBERCOTE PC 3331X, SILBERCOTE PC 4352Z, SILBERCOTE PC 4852X, SILBERCOTE PC 6222X, SILBERCOTE PC 6352Z, SILBERCOTE PC 6802X, SILBERCOTE PC 8152Z, SILBERCOTE PC 8153X, SILBERCOTE PC 8602X; SILVET/SILVEX 890 series, and SILVET/SILVEX 950 series manufactured by Silberline Manufacturing Co., Inc.

For blending of the bright pigment, a raw material containing aluminum powder (Alpaste 1200M manufactured by TOYO ALUMINIUM K.K.) is used, for example.

The bright pigment of a single kind or combination of two or more kinds thereof may be used.

Content of the bright pigment in the toner particles is preferably from 5% by mass to 40% by mass, more preferably from 10% by mass to 35% by mass, and even more preferably from 10% by mass to 30% by mass, with respect to the total amount of the toner particles.

When the content of the bright pigment is smaller than the preferable lower limit, it is difficult to obtain metallic luster or pearl luster. Meanwhile, when the content thereof exceeds the preferable upper limit, fixability or fastness of an image is likely to be deteriorated.

Resistivity (electric resistivity) of the binder resin used in the toner particles is, for example, preferably equal to or greater than $1.0\times10^{10}$ (Ω·cm) and more preferably from $1.0\times10^{10}$ to $1.0\times10^{12}$ (Ω·cm). When the resistivity of the binder resin is equal to or greater than the preferable lower limit, a developer containing thereof is likely to have a sufficient charge amount, regardless of the environment. Meanwhile, when the resistivity thereof is equal to or smaller than the preferable upper limit, the preferable fixability is obtained.

In the present disclosure, the resistivity (electric resistivity) can be measured using LCR meter (for example, AG-4311 manufactured by Ando Electric Co., Ltd).

A weight average molecular weight (Mw) of the binder resin is preferably from 3,000 to 1,000,000 and more preferably from 5,000 to 600,000.

When the Mw of the binder resin is smaller than the preferable lower limit, heat resistance storability of the toner is likely to be low. As the Mw of the binder resin increases, a fixation temperature increases. Accordingly, it is not preferable that the Mw of the binder resin exceeds the preferable upper limit, since high temperature is needed to fix the toner containing the binder resin.

In the present disclosure, the weight average molecular weight (Mw) of the resin represents a value of polystyrene conversion by gel permeation chromatography.

Examples of the binder resin include a polyester resin, a polystyrene resin, a polyurethane resin, and an epoxy resin. Among these, the polyester resin is preferable, because excellent low temperature fixability is obtained.

Among the polyester resins, a polyester resin having a glass transition temperature of 45° C. to 70° C. is preferable and a polyester resin having a glass transition temperature of 50° C. to 65° C. is more preferable. The glass transition temperature of the resin can be measured by differential scanning calorimetry.

Among the polyester resins, a polyester resin having an acid value of 5 to 30 is preferable, and a polyester resin having an acid value of 5 to 20 is more preferable.

As the polyester resin, a polycondensation product of a di- or higher valent alcohol component and a di- or higher valent carboxylic acid component can be used, for example, (see JP-A-7-175260).

Examples of the divalent alcohol component include a bisphenol A alkylene oxide adduct such as polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxyethylene(2.0)-2,2-bis(4-hydroxyphenyl) propane, and polyoxypropylene (6)-2,2-bis(4-hydroxyphenyl) propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Among these, as the divalent alcohol component, a bisphenol A alkylene (2 or 3 carbon atoms) oxide adduct (average molar number added of 1 to 10), ethylene glycol, propylene glycol, 1,6-hexanediol, bisphenol A, and hydrogenated bisphenol A are preferable.

Examples of the tri- or higher valent alcohol component include sorbitol, 1,2,3,6-hexanetetrol, 1,4-sorbitan, pentaerythritol, dipentaerythritol, tripentaerythritol, 1,2,4-butane triol, 1,2,5-pentane triol, glycerol, 2-methyl propane triol, 2-methyl-1,2,4-butane triol, trimethylol ethane, trimethylol propane, and 1,3,5-trihydroxy methyl benzene. Among these, as the tri- or higher valent alcohol component, sorbitol, 1,4-sorbitan, pentaerythritol, glycerol, and trimethylol propane are preferable.

The di- or higher valent alcohol component may be used alone as one kind or may be used in combination of two or more kinds thereof.

Examples of the di- or higher valent carboxylic acid component include carboxylic acid, a carboxylic acid anhydride, and carboxylic acid ester.

Examples of the divalent carboxylic acid component include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acid such as N-dodecenyl succinic acid, alkyl succinic acid such as N-dodecyl succinic acid, an anhydride of these acids, and alkyl ester. Among these, as the divalent carboxylic acid component, maleic acid, fumaric acid, terephthalic acid, and alkenyl succinic acid (preferably succinic acid having an alkenyl group having 2 to 20 carbon atoms) are preferable.

Examples of the tri- or higher valent carboxylic acid component include 1,2,4-benzene tricarboxylic acid (trimellitic acid), 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxy propane, 1,2,4-cyclohexane tricarboxylic acid, tetra (methylene carboxyl) methane, 1,2,7,8-octane tetracarboxylic acid, pyromellitic acid, Empol trimer acid, or an anhydride of these acids, and alkyl ester. Among these, as the tri- or higher valent carboxylic acid component, 1,2,4-benzene tricarboxylic acid, or an anhydride of the acid, or alkyl (preferably alkyl having 1 to 12 carbon atoms) ester is preferable.

The di- or higher valent carboxylic acid component of single kind or combination of two or more kinds thereof may be used.

As the polyester resin, crystalline polyester may be used. As the crystalline polyester, a polycondensation product of diol and dicarboxylic acid is used, for example.

Examples of diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetra-decanediol, 1,18-octadecanediol, and 1,20-eicosanediol.

Examples of dicarboxylic acid include terephthalic acid, isophthalic acid, orthophthalic acid, t-butyl isophthalic acid, 2,6-naphthalene dicarboxylic acid, 4,4'-biphenyl dicarboxylic acid, fumaric acid, adipic acid, sebacic acid, 1,10-decane dicarboxylic acid, and 1,12-dodecane dicarboxylic acid.

An esterification catalyst may be used to promote polycondensation of the di- or higher valent alcohol component and di- or higher valent carboxylic acid component. As the esterification catalyst, dibutyltin oxide or the like is used.

The binder resin of one kind or combination of two or more kinds thereof may be used.

Content of the binder resin in the toner particles is preferably from 50% by mass to 95% by mass, more preferably from 60% by mass to 95% by mass, and even more preferably from 65% by mass to 90% by mass, with respect to the total amount of the toner particles.

When the content of the binder resin is smaller than the preferable lower limit, it is difficult to ensure fixability and fastness of an image. Meanwhile, when the content thereof exceeds the preferable upper limit, it is difficult to ensure fixability and brilliance and toner scattering tends to occur.

In addition to the flaky bright pigment and the binder resin, the toner particles may contain other components (arbitrary components), if necessary. Examples of the arbitrary components include a colorant excluding the bright pigment, wax, a charge adjusting agent, a surfactant, a basic compound, and an aggregating agent.

The toner particles may contain the colorant excluding the bright pigment, in order to adjust a color tone of an image.

Examples of the colorant include carbon black and organic or inorganic pigments and dyes.

Examples of carbon black include acetylene black, furnace black, thermal black, channel black, and Ketjen black.

As the pigments and dyes, a yellow pigment, a magenta pigment and a cyan pigment are used, and examples thereof include Fast Yellow G, benzidine yellow, India Fast Orange, Irgazin Red, naphthol azo, Carmine FB, permanent Bordeaux FRR, Pigment Orange R, lithol Red 2G, Lake Red C, rhodamine FB, rhodamine B lake, phthalocyanine blue, Pigment Blue, Brilliant Green B, phthalocyanine green, and quinacridone.

The colorant on one kind or combination of two or more kinds thereof may be used.

Examples of a preferable yellow pigment include C.I. Pigment yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185; and C.I. Vat Yellow 1, 3, and 20. The yellow pigment of one kind or combination of two or more kinds thereof may be used.

Examples of a preferable magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238; C.I. Pigment Violet 19; and C.I. Vat Red 1, 2, 10, 13, 15, 23, 29, and 35. The magenta pigment of one kind or combination of two or more kinds thereof may be used.

Examples of a preferable cyan pigment include C.I. Pigment Blue 2, 3, 15, 16, and 17; C.I. Vat Blue 6; and C.I. Acid Blue 45. The cyan pigment of one kind or combination of two or more kinds thereof may be used.

The toner particles preferably contain wax, in order to improve fixability.

Examples of wax include aliphatic hydrocarbon-based wax such as low molecular weight polyethylene, low molecular weight polypropylene, a polyolefin copolymer, polyolefin wax, microcrystalline wax, paraffin wax, or Fischer-Tropsch wax, an oxide of aliphatic hydrocarbon-based wax such as oxidized polyethylene wax; a block copolymer thereof; vegetable wax such as candelilla wax, carnauba wax, Japan wax, jojoba wax, or rice wax, animal wax such as beeswax, lanolin, or spermaceti; mineral wax such as ozocerite, ceresin, or petrolatum; wax including aliphatic ester as a main component such as montanic acid ester wax, or castor wax; a material obtained by deoxidizing a part of or entire aliphatic ester such as deoxidized carnauba wax; saturated straight chain fatty acids such as palmitic acid, stearic acid, montanic acid, or long-chain alkyl carboxylic acid including a long-chain alkyl group; unsaturated fatty acid such as brassidic acid, eleostearic acid, or parinaric acid; saturated alcohol such as stearyl alcohol, eicosyl alcohol, behenyl alcohol, carnaubyl Bill alcohol, ceryl alcohol, melissyl alcohol, or long-chain alkyl alcohol including a long-chain alkyl group; polyhydric alcohol such as sorbitol; fatty acid amide such as linoleic acid amide, oleic acid amide, or lauric acid amide; saturated fatty acid bisamide such as methylene-bis-stearic acid amide, ethylene-bis-capric acid amide, ethylene-bis-lauric acid amide, or hexamethylene bis-stearic acid amide; unsaturated fatty acid amides such as ethylene-bis-oleic acid amide, hexamethylene bis-oleic acid amide, N,N'-dioleyl adipic acid amide, or N,N'-dioleyl sebacic acid amide; aromatic bisamides such as m-xylene-bis-stearic acid amide, or N,N'-distearyl isophthalic acid amide; fatty acid metal salt (generally so-called metal soap) such as calcium stearate, calcium laurate, zinc stearate, or magnesium stearate; wax obtained by grafting aliphatic hydrocarbon-based wax using a vinyl-based monomer such as styrene or acrylic acid; partially esterified material of fatty acid and polyhydric alcohol such as behenic acid monoglyceride; and a methyl ester compound including a hydroxy group, which is obtained by hydrogenation of vegetable oil.

Among these, as the wax, aliphatic hydrocarbon-based wax is preferable, because a preferable fixability can be obtained.

The wax of one kind or combination of two or more kinds thereof may be used.

Content of the wax in the toner particles is preferably from 2% by mass to 20% by mass and more preferably from 4% by mass to 12% by mass with respect to the total amount of the toner particles.

When the content of the wax is smaller than the preferable lower limit, offset properties are insufficient and it is difficult to ensure fixability. Meanwhile, when the content thereof exceeds the preferable upper limit, filming tends to occurs.

The toner particles may contain a charge adjusting agent, in order to adjust a frictional electrification charge amount.

Examples of the charge adjusting agent include a metal-containing azo compound and a metal-containing salicylic acid derivative compound.

As the metal contained in the metal-containing azo compounds, a complex or complex salt including iron, cobalt, or chrome as the metal, or a mixture thereof is preferable.

As the metal contained in the metal-containing salicylic acid derivative compound, a complex or complex salt including zirconium, zinc, chrome, or boron as the metal, or a mixture thereof is preferable.

The toner particles may contain a surfactant. The surfactant mainly acts as a dispersant, when manufacturing the toner particles. Examples of the surfactant include an anionic surfactant such as sulfuric acid ester salt, sulfonate, phosphate ester salt, soap, or carboxylic acid salt; a cationic surfactant such as amine salt or a quaternary ammonium salt; and nonionic surfactant such as polyethylene glycol based, alkyl phenol ethylene oxide adduct based, or polyalcohol based.

The toner particles may contain a basic compound. The basic compound mainly acts as a dispersant, when manufacturing the toner particles. As the basic compound, an amine compound is used. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyl diethanolamine, N,N-dimethyl-1,3-diaminopropane, and N,N-diethyl-1,3-diaminopropane.

The toner particles may contain an aggregating agent. The aggregating agent is arbitrarily used, in order to promote aggregation between the bright pigment and the binder resin or the aggregation among the bright pigment, the binder resin, and the wax, when manufacturing the toner particles. Examples of the aggregating agent include metal salt such as sodium chloride, calcium chloride, calcium nitrate, barium chloride, magnesium chloride, zinc chloride, magnesium sulfate, aluminum chloride, aluminum sulfate, or potassium aluminum sulfate; nonmetal salt such as ammonium chloride or ammonium sulfate; an inorganic metal salt polymer such as poly aluminum chloride, poly aluminum hydroxide, or calcium polysulfide; a polymer aggregating agent such as polymethacrylic acid ester, polyacrylic acid ester, polyacrylamide, an acrylamide-sodium acrylate copolymer; a coagulating agent such as polyamine, polydiallyl ammonium halide, polydiallyl dialkyl ammonium halide, melanin formaldehyde condensates, or dicyandiamide; alcohols such as methanol, ethanol, 1-propanol, 2-propanol, 2-methyl-2-propanol, 2-methoxyethanol, 2-ethoxyethanol, or 2-butoxyethanol; an organic solvent such as acetonitrile or 1,4-dioxane; inorganic acid such as hydrochloric acid or nitric acid; and organic acid such as formic acid or acetic acid. Among these, nonmetal salt is preferable and ammonium sulfate is particularly preferable, because a preferable promotion effect of aggregation can be obtained.

In addition to the toner particles, the electrophotographic toner of the exemplary embodiment may contain external additives.

Inorganic fine particles can be used as the external additive, in order to apply fluidity to the toner or adjust charging properties. Examples of an inorganic material configuring the inorganic fine particles include silica, titania, alumina, strontium titanate, and tin oxide. The inorganic particles of one kind or combination of two or more kinds thereof may be used.

As the external additive, the inorganic fine particles subjected to surface treatment by a hydrophobizing agent are preferable in a viewpoint of improving environmental stability. In addition, as the external additive, resin fine particles having a particle diameter equal to or smaller than 1 μm can be used in order to improve cleaning properties. As the resin configuring the resin fine particles, a styrene acrylic acid copolymer, a polymethyl methacrylate, or a melamine resin may be used.

Content of the external additive of the electrophotographic toner is preferably approximately from 0.01 parts by mass to 10 parts by mass with respect to 100 parts by mass of the toner particles.

Hereinafter, characteristics of the electrophotographic toner of the present embodiment will be described.

The electrophotographic toner of the present embodiment contains toner particles which are obtained by coating flaky bright pigment with a binder resin. In addition, a ratio of the exposed surface area of the bright pigment with respect to the surface area of the toner particles is equal to or smaller than 20%, preferably equal to or smaller than 10%, and more preferably from 0% to 5%. When the exposed surface area of the bright pigment is equal to or smaller than the upper limit, preferable charge properties (charge amount and stabilization thereof) tend to be obtained, and as a result an excellent image is likely to be obtained.

The exposed surface area of the bright pigment with respect to the surface area of the toner particles can be measured by performing element analysis of the toner particle surface based on an energy dispersion X-ray analysis (EDX analysis).

For example, when the bright pigment is metal powder, the EDX analysis is performed by setting the metal element thereof as a detection target. When the bright pigment is flaky inorganic crystalline substance coated with metal oxide, the EDX analysis is performed by setting a metal element of metal oxide as a detection target.

When the toner contains the external additive, the external additive attached to the toner particle surface is removed before the EDX analysis is performed. Also in this case, the area of the metal, which is the detection target, with respect to the surface area of the toner from which the external additive is removed, is equal to or smaller than 20%.

The external additive attached to the toner particle surface can be removed as follows, for example.

First, the toner and the surfactant are mixed with each other and a toner dispersion is prepared (dispersion step). Then, an ultrasonic process is performed for the toner dispersion (impact step). A process of centrifugation is performed for the toner dispersion after the ultrasonic process. Then, a solid-liquid separation operation such as decantation is performed (separation step). The obtained solid body is washed (washing step) and then dried (drying step).

The resistivity (electric resistivity) of toner of the present embodiment is preferably equal to or greater than $1.0\times10^{10}$ (Ω·cm) and more preferably from $3.0\times10^{10}$ to $1.0\times10^{12}$ (Ω·cm). When the resistivity of the toner is equal to or greater than the preferable lower limit, developing properties or transfer properties are improved. The toner within the range is not likely be affected by an environment and is likely to stabilize the charge amount.

The charge amount of the toner of the present embodiment is preferably approximately from 10 (C/kg) to 40 (C/kg) and more preferably approximately from 15 (C/kg) to 35 (C/kg). When the charge amount of the toner is equal to or greater than the preferable lower limit, an excellent image is likely to be obtained. Meanwhile, when the charge amount thereof is equal to or smaller than the preferable upper limit, the toner scattering is unlikely to occur.

A volume average particle diameter of the toner of the exemplary embodiment is preferably approximately 5 μm to 30 μm and more preferably approximately from 8 μm to 25 μm. When the volume average particle diameter of the toner is equal to or greater than the preferable lower limit, brilliance further increases. Meanwhile, when the volume average particle diameter thereof is equal to or smaller than the preferable upper limit, it is easy to control the developing and transferring.

In the electrophotographic toner of the present embodiment described above, the exposed surface area of the bright pigment with respect to the surface area of the toner particles is equal to or smaller than 20%. As described above, since the bright pigment is slightly exposed and is sufficiently coated with the binder resin, the toner has a sufficient charge amount. In addition, the toner is less likely to be affected by the environment and the charge amount is likely to be stabilized. Therefore, according to the toner of the present embodiment, it is possible to obtain an excellent image.

Hereinafter, a manufacturing method of the electrophotographic toner of the present embodiment will be described.

The manufacturing method of the electrophotographic toner of the present embodiment is not particularly limited. However, a chemical method is preferable to a pulverization method, because the chemical method are less likely to pulverize the bright pigment and more likely to have brilliance.

Among the chemical methods, a chemical method in which a polyester resin can be used and which enables low temperature fixation is particularly preferable. As the manufacturing method of the toner, a manufacturing method including an aggregating step, a fusion step, a washing step, a drying step, and an external addition step is used.

In the aggregating step, the particles of the bright pigment and a dispersion of the binder resin are mixed in an aqueous solvent, for example. As a result, heteroaggregation of the bright pigment particles and the resin fine particles occurs and an aggregate of the bright pigment and the resin fine particles that coat the surface of the bright pigment particles is obtained. In the present disclosure, the heteroaggregation means that the resin fine particles are attached to the surface of the bright pigment particles.

A combination mass ratio of the resin fine particles to the bright pigment particles is preferably equal to or greater than 1, or more preferably from 2 to 20. When the mass ratio is equal to or greater than the preferable lower limit, the sufficient surface of the bright pigment particles is likely to be coated with the resin fine particles. That is, the exposed surface area of the bright pigment with respect to the surface area of the toner particles can be adjusted to be equal to or smaller than 20%. Meanwhile, when the mass ratio is equal to or smaller than the preferable upper limit, it is easy to ensure fixability and brilliance.

When the particles of the bright pigment and the resin dispersion are mixed with each other, the wax, the aggregating agent, the charge adjusting agent, and the like may be also mixed.

Alternatively, after the particles of the bright pigment and a resin dispersion are mixed with each other, the obtained mixed solution and the resin dispersion of the binder resin may be mixed with each other. As a result, the surface of the bright pigment particles is sufficiently coated with the resin fine particles.

In the fusion step, the aggregate obtained in the aggregation step is subjected to a thermal process. Through the fusion step, the bright pigment particles and the resin fine particles configuring the aggregate are fused and fused particles are obtained. The operation for the fusion step may be performed at the same time as the operation for the aggregation step.

A heating temperature of the aggregate is determined considering the types of the bright pigment and the binder resin, a melting temperature, and the like. By adjusting the heating temperature of the aggregate, it is possible to adjust the exposed surface area of the bright pigment with respect to the surface area of the toner particles to be equal to or smaller than 20%. The time period of the heating of the aggregate is preferably approximately 2 hours to 10 hours.

The washing step is suitably performed by a well-known washing method. The washing step is, for example, performed by repeating washing with water and filtering. The washing step is preferably repeated until conductivity of filtrate is equal to or smaller than 50 μS/cm.

The drying step is a step of drying the fused particles after the washing step. The drying step is suitably performed by a well-known drying method.

In the external addition step, the fused particle group after the drying step and the external additive are mixed with each other and a desired toner is obtained.

After the external additive step, a sieving process may be performed. As a result, coarse particles or foreign materials are removed. Examples of a device used in the sieving process include ULTRA SONIC (manufactured by Koei Sangyo Co., Ltd.), Gyro shifter (manufactured by Tokuju Corporation), VIBRASONIC SYSTEM (manufactured by Dalton Co., Ltd.), SONICLEAN (manufactured by Sinto Kogio, Ltd.), TURBO SCREENER (manufactured by Freund Turbo), MICRO SHIFTER (manufactured by Makino Mfg. Co., Ltd.), and a circular vibrating sieve.

Examples of a mixing machine used when manufacturing the toner include Henschel mixer (manufactured by Mitsui Mining Co., Ltd.), Super mixer (manufactured by Kawata Mfg. Co., Ltd.), Ribocone (manufactured by Okawara Mfg. Co., Ltd.), Nauta mixer (manufactured by Hosokawa Micron, Co., Ltd.), Turbulizer (manufactured by Hosokawa Micron, Co., Ltd.), Cyclomixer (manufactured by Hosokawa Micron, Co., Ltd.), Spiral Pin Mixer (manufactured by Pacific Machinery & Engineering Co., Ltd.), and Lodige Mixer (manufactured by Matsubo Corporation).

Hereinafter, the developer of the present embodiment will be described.

The developer of the present embodiment contains the electrophotographic toner of the present embodiment.

As the developer, a nonmagnetic one-component developer or a two-component developer is suitably used. When the electrophotographic toner of the present embodiment is used for the two-component developer, a usable carrier is not particularly limited and is appropriately set by a person of ordinary skill in the art.

The developer may contain fine particles of a resin material, such as a styrene/acrylic copolymer, a polyacrylic acid polymer, a melamine polymer, and the like. Examples of the resin fine particle group which may be contained in the developer include MP-300 (average particle diameter of 0.10 μM), MP-1451 (average particle diameter of 0.15 μM), MP-2200 (average particle diameter of 0.35 μM), MP-1000 (average particle diameter of 0.40 μM), MP-2701 (average particle diameter of 0.40 μM), MP-5000 (average particle diameter of 0.40 μM), MP-5500 (average particle diameter of 0.40 μM), and MP-4009 (average particle diameter of 0.60 μM) which are resin fine particles manufactured by Soken Chemical & Engineering Co., Ltd.; P2000 which is resin fine particles manufactured by Nippon Paint Co., Ltd. (average particle diameter of 0.48 μM); EPOSTAR-S (average particle diameter of 0.20 μM), EPOSTAR-FS (average particle diameter of 0.20 μM), and EPOSTAR-S6 (average particle diameter of 0.40 μM) manufactured by NIPPON SHOKUBAI CO., LTD. Among these, as the resin fine particles, MP-2200 and MP-1000 are particularly preferable, in viewpoints of the particle diameters, charging properties, and mechanical strength of the toner and the carrier. The resin fine particles of one kind or combination of two or more kinds thereof may be used. The content of the resin fine particle group in the developer is approximately from 0.01 parts by mass to 0.36 parts by mass with respect to 100 parts by mass of the toner.

The developer of the present embodiment may be used in an image forming apparatus such as a multi-function peripheral (MFP), the image forming onto an electrophotographic recording medium. When the developer of the present embodiment is used, it is possible to stably obtain an excellent image having high brilliance.

Hereinafter, a toner cartridge according to an embodiment will be described.

In the toner cartridge of the embodiment, the electrophotographic toner of the above embodiment is contained in a container. For the container, a well-known container can be used.

By using the toner cartridge of the present embodiment in the image forming apparatus, it is possible to stably obtain an excellent image having high brilliance.

Hereinafter, an image forming apparatus according to an embodiment will be described with reference to the drawings.

In the image forming apparatus of the present embodiment, the electrophotographic toner of the above embodiment is contained in an apparatus main body. For the apparatus main body, a general electrophotographic apparatus can be used.

FIGURE illustrates the image forming apparatus according to the present embodiment.

An image forming apparatus 20 includes an intermediate transfer belt 7, a first image forming unit 17A and a second image forming unit 17B which are provided on the intermediate transfer belt 7 in this order, and a fixing device 21 provided downstream with respect to the intermediate transfer belt 7 in a sheet conveying direction. The first image forming unit 17A is provided downstream with respect to the second image forming unit 17B along a movement direction of the intermediate transfer belt 7, that is, along a proceeding direction of an image forming process.

The first image forming unit 17A includes a photoreceptor drum 1*a*, a cleaning device 16*a*, a charging device 2*a*, an exposing device 3*a*, and a first developing device 4*a* provided around the photoreceptor drum 1*a* in this order, and a primary transfer roller 8*a* which is provided so as to face the photoreceptor drum 1*a* across the intermediate transfer belt 7 disposed therebetween.

The second image forming unit 17B includes a photoreceptor drum 1*b*, a cleaning device 16*b*, a charging device 2*b*, an exposing device 3*b*, and a second developing device 4*b* provided around the photoreceptor drum 1*b* in this order, and a primary transfer roller 8*b* which is provided so as to face the photoreceptor drum 1*b* across the intermediate transfer belt 7 disposed therebetween.

The developer containing the electrophotographic toner of the embodiment described above is contained in the first developing device 4*a* and the second developing device 4*b*. The toner may be supplied from a toner cartridge (not shown).

A primary transfer power source 14*a* is connected to the primary transfer roller 8*a*. A primary transfer power source 14*b* is connected to the primary transfer roller 8*b*.

A secondary transfer roller 9 and a back-up roller 10 are disposed so as to face each other across the intermediate transfer belt 7 and downstream with respect to the first image forming unit 17A along the moving direction of the intermediate transfer belt 7. A secondary transfer power source 15 is connected to the secondary transfer roller 9.

The fixing device 21 includes a heating roller 11 and a pressing roller 12 disposed so as to face each other.

For example, the image forming is performed as follows using the image forming apparatus 20.

First, the photoreceptor drum 1*b* is uniformly charged by the charging device 2*b*. The exposure is performed by the exposing device 3*b* and an electrostatic latent image is formed. Then, the development is performed with the toner supplied from the developing device 4*b* and a second toner image is obtained.

The photoreceptor drum 1*a* is uniformly charged by the charging device 2*a*. The exposure is performed by the exposing device 3*a* based on first image information (second toner image) and an electrostatic latent image is formed. Then, the development is performed with the toner supplied from the developing device 4*a* and a first toner image is obtained.

The second toner image and the first toner image are transferred onto the intermediate transfer belt 7 in this order using the primary transfer rollers 8*a* and 8*b*.

An image obtained by laminating the second toner image and the first toner image in this order on the intermediate transfer belt 7 is secondarily transferred onto a recording medium (not shown) passing through a nip formed between the secondary transfer roller 9 and the back-up roller 10. As a result, the image obtained by laminating the first toner image and the second toner image in this order is formed on the recording medium.

The kind of the bright pigment used in the toner in the developing device 4*a* and the developing device 4*b* is arbitrarily selected. The image forming apparatus 20 shown in FIGURE includes two developing devices, but the image forming apparatus may include three or more developing devices depending on the kind of toner used.

The image forming apparatus 20 of FIGURE forms an entire image with toner, but the image forming apparatus of the present embodiment is not limited thereto, and may form a part of the image with ink.

According to the image forming apparatus of the exemplary embodiment, it is possible to stably form an excellent image having high brilliance.

According to at least one exemplary embodiment described above, by obtaining the toner particles having exposed surface area of the bright pigment equal to or smaller than 20%, a sufficient charge amount is obtained and the image forming process is less likely to be affected by the environment. Therefore, when the toner of the above embodiment is used, developing properties and transfer properties are likely to be improved and an excellent image is likely to be obtained.

Examples

The following examples are for describing an example of the above embodiment. However, the embodiment is not interpreted to be limited to the following examples.

Example 1

Hereinafter, preparation of the resin dispersion will be described.

As the binder resin, a polyester resin (manufactured by Kao Corporation, glass transition temperature of 62° C., acid value of 20, and resin resistivity of $3.2\times10^{10}$ (Ω·cm)) was used.

20 parts by mass of the binder resin, 1.5 parts by mass of an anionic surfactant (manufactured by Kao Corporation, Neopelex G-65) as the dispersant, 0.5 parts by mass of an amine compound (manufactured by Wako Pure Chemical Industries, Ltd., dimethylaminoethanol), and 78 parts by mass of ion exchange water were added in CLEARMIX (manufactured by M Technique Co., Ltd., CLM-2.2S).

After the mixture was heated and the temperature thereof reached 90° C., a rotation rate of the CLEARMIX was set as 18000 rpm and the mixture was stirred for 30 minutes. The, the mixture was cooled and a resin dispersion was obtained.

The volume average particle diameter of the resin fine particles dispersed in the obtained resin dispersion was measured using SALD7000 (manufactured by Shimadzu Corporation). As a result, a volume average particle diameter of the resin fine particles was found to be 135 nm.

Hereinafter, preparation of the wax dispersion will be described.

As the wax, paraffin wax (manufactured by Nippon Seiro Co., Ltd., HNP-9) was used. 20 parts by mass of the wax, 1.0 parts by mass of an anionic surfactant (manufactured by Kao Corporation, Neopelex G-65) as the dispersant, and 79 parts by mass of ion exchange water were mixed with each other and processed using a homogenizer (manufactured by IKA Japan, K.K.) for 10 minutes while heating. As a result, a wax dispersion was obtained.

A volume average particle diameter of the wax fine particles dispersed in the obtained wax dispersion was found to be 354 nm.

Hereinafter, preparation of the toner will be described.

Aggregation Step

Flaky mica coated with metal oxide (titanium oxide, iron oxide, and tin oxide) (IRIODIN 323 manufactured by MERCK; aspect ratio of 65, volume average particle diameter of 9 μm) was used as the bright pigment.

15 parts by mass of the bright pigment (flaky mica coated with metal oxide), 200 parts by mass of the resin dispersion, 20 parts by mass of the wax dispersion, and 250 parts by mass of the ion exchange water were added in a 1000 mL separable flask and a mixed solution thereof was obtained.

The mixed solution was stirred using Fullzone blade for 30 minutes while maintaining the temperature of the mixed solution at 30° C. A rotation rate at that time was set to 200 rpm.

After that, 300 parts by mass of a 10 mass % aqueous ammonium sulfate solution was dripped for 120 minutes. After completing the dripping of the aqueous ammonium sulfate solution, the mixed solution was stirred for 60 minutes.

Fusion Step

Then, the temperature of the mixed solution was increased to 60° C. for 3 hours and further increased to 70° C. for 2 hours and maintained for 1 hour. After that, the mixed solution was cooled to a room temperature and scaly (flaky) fused particles having a volume average particle diameter of 18 μm were obtained.

Washing Step

The obtained scaly fused particles were washed with water using Buchner funnel so that conductivity of washing filtrate is equal to or smaller than 3 μS/cm.

Drying Step

Then, the mixed solution was dried and toner particles were obtained. A composition of the toner particles was 25.4% by mass of the bright pigment, 67.8% by mass of the binder resin, and 6.8% by mass of the wax.

External Addition Step

The obtained toner particles and 1 part by mass of silica (RX200 manufactured by Nippon Aerosil co. ltd.) with respect to 100 parts by mass of the toner particles were mixed with each other and the toner was obtained.

Examples 2-6 and Comparative Example 1

A resin dispersion used in each example was prepared in the same manner as in the preparation method of the resin dispersion in Example 1, using binder resins (polyester resins) having different resistivity shown in Table 1.

A toner of each example was obtained in the same manner as in the manufacturing of the toner in Example 1, except for using the different resin dispersion.

Hereinafter, the exposed surface area of the bright pigment with respect to the surface area of the toner particles will be described.

After the drying step, element mapping of the toner particle surface was performed using an energy dispersion X-ray analysis (EDX analysis). The total area of titanium, iron, and tin in the toner particle surface was measured. Based on the measured results, the exposed surface area of the bright pigment with respect to the surface area of the toner particles was calculated.

Hereinafter, evaluation of charge properties (charge amount and stabilization thereof) of the toner will be described.

In the environment of a low temperature and low humidity (temperature of 10° C. and relative humidity of 20%), the toner of each example and a ferrite carrier coated with straight silicone were mixed with each other, and each developer was prepared. The charge amounts of the toners of the prepared developers were measured by an absorption type blow-off method.

Then, the developers were kept in the atmosphere of a high temperature and high humidity (temperature of 30° C. and relative humidity of 85%) for 48 hours. Then, the charge amounts of the toners of the developers were measured by an absorption type blow-off method.

When a difference ($Q^L-Q^H$) between the charge amount ($Q^L$) at the low temperature and low humidity and the charge amount ($Q^H$) at high temperature and high humidity is smaller than 20 (C/kg), the developer is likely to be affected by an environment and it is possible to obtain an excellent image. When the difference ($Q^L-Q^H$) is equal to or smaller than 18 (C/kg), the developer is more likely to be affected by an environment and it is possible to obtain a more excellent image.

The resistivity of the binder resin, the composition of the toner particles, the exposed surface area of the bright pigment with respect to the surface area of the toner particles, and the charge amount of toner of the toner of each example are shown in Table 1.

TABLE 1

| | Toner | | | | | | | |
|---|---|---|---|---|---|---|---|---|
| | | Composition of toner particles | | | Exposed surface area of bright pigment with | Charge amount | | |
| | Resistivity of binder resin ($\times 10^{10}$ Ω · cm) | Bright pigment (% by mass) | Binder resin (% by mass) | Wax (% by mass) | respect to surface area of toner particle (%) | Low temperature and low humidity condition $Q^L$ (C/kg) | High temperature and high humidity condition $Q^H$ (C/kg) | Difference $Q^L - Q^H$ (C/kg) |
| Ex. 1 | 3.2 | 25.4 | 67.8 | 6.8 | 4.0 | 32 | 28 | 4 |
| Ex. 2 | 1.6 | 25.4 | 67.8 | 6.8 | 4.5 | 29 | 20 | 9 |
| Ex. 3 | 1.0 | 25.4 | 67.8 | 6.8 | 3.8 | 23 | 8 | 15 |
| Ex. 4 | 3.2 | 30.6 | 62.6 | 6.8 | 8.1 | 30 | 22 | 8 |
| Ex. 5 | 3.2 | 38.5 | 54.8 | 6.8 | 17.4 | 28 | 14 | 14 |
| Ex. 6 | 0.9 | 25.4 | 67.8 | 6.8 | 3.9 | 22 | 6 | 16 |
| Com. Ex. 1 | 3.2 | 51.7 | 41.5 | 6.8 | 23.9 | 26 | 6 | 20 |

From the results shown in Table 1, it is confirmed that the toners in Examples 1 to 6 have smaller change in the charge amount by the change of the environment, compared to the toner in Comparative Example 1. Therefore, according to the toner of the present embodiment, it is found that the charge amount is stabilized and an excellent image is obtained.

Example 7

Toner particles were obtained in the same manner as in the aggregating step, the fusion step, the washing step, and the drying step performed in Example 1.

External Addition Step

The obtained toner particles, 1 part by mass of silica (RX200 manufactured by Nippon Aerosil co. ltd.) with respect to 100 parts by mass of the toner particles, and 0.5 parts by mass of titanium oxide (NKT90 manufactured by Nippon Aerosil co. ltd.) were mixed with each other, and toner was obtained.

With respect to the obtained toner, element mapping of the toner particle surface was performed using EDX. When the total area of titanium, iron, and tin in the toner particle surface was measured, it was 98% with respect to the surface area of the toner particles. From the results, it was confirmed that the titanium oxide externally added is exposed on substantially the entire surface of the toner particles.

Further, with respect to the toner, the charge amount was measured in the same manner as in the evaluation of the charge properties (charge amount and stabilization thereof). As a result, the charge amount ($Q^L$) at the low temperature and low humidity was 19 (C/kg), the charge amount ($Q^H$) at the high temperature and high humidity was 12 (C/kg), and the difference ($Q^L$–$Q^H$) between the two amounts was 7 (C/kg).

Then, the operations of the following steps (dispersion step, impact step, separation step, washing step, and drying step) were further performed and the external additive attached to the toner particle surface was removed.

Dispersion Step 5.5 parts by mass of the toner, 28.4 parts by mass of ion exchange water, and 6.4 parts by mass of surfactant (manufactured by Kao Corporation, Neopelex G-65) were added to a 100 mL beaker. Then, the mixed solution was stirred using a magnetic stirrer until the separation of the toner was unobserved, and a dispersion was obtained.

Impact Step

A sound wave is continuously applied to the dispersion obtained in the dispersion step for 10 minutes using an ultrasonic cleaning machine (ASONE US-1R).

Separation Step

The operation of the following procedures 1) to 4) was performed.

Procedure 1): 35 mL of the dispersion after the impact step was poured into a centrifuge tube and stirred by adding ion exchange water so that the entire amount is 45 mL.

Procedure 2): Centrifugation is performed for the centrifuge tube at 1000 rpm for 15 minutes using a centrifugal separator (HSIANGTAI CN-2060).

Procedure 3): After the procedure 2), supernatant liquid in the centrifuge tube is removed by decantation, and ion exchange water is added and stirred so that the entire amount is 45 mL.

Procedure 4): The operation of procedure 2), procedure 3), and procedure 2) described above are further performed in this order, and after the final procedure 2), the supernatant liquid in the centrifuge tube is removed by decantation and a solid body was obtained.

Washing Step

The solid body obtained in the separation step and 100 mL of ion exchange water were mixed with each other, and then filtering was performed. ADVANTEC GC90 was used for filter paper.

Drying Step

The solid body separated by filtering in the washing step was dried in a vacuum state for 8 hours and toner from which the external additive is removed (hereinafter, "external additive-removed toner") was obtained.

With respect to the obtained external additive-removed toner, element mapping of the external additive-removed toner particle surface was performed using EDX. The total surface area of titanium, iron, and tin in the external additive-removed toner particle surface was measured. Based on the measured results, the ratio of the total surface area of titanium, iron, and tin with respect to the surface area of the external additive-removed toner particle was 13.4%.

Example 8

A toner was manufactured as follows, using Alpaste 1200M (manufactured by TOYO ALUMINIUM K.K.) in which aluminum powder is dispersed in a solution (dispersion medium).

First, the dispersion medium was separated and removed from Alpaste 1200M using Buchner funnel. Then, the residual solid body was washed with ion exchange water the amount of which is 300 times the weight of the solid body. After that, the solution was dried and flaky aluminum flake (aspect ratio of 120, volume average particle diameter of 10 μm) was obtained.

The toner particles were obtained in the same manner as in the aggregating step, the fusion step, the washing step, and the drying step performed in Example 1, except for using the flaky aluminum flake as the bright pigment.

External Addition Step

The obtained toner particles and 1 part by mass of silica (RX200 manufactured by Nippon Aerosil co. ltd.) with respect to 100 parts by mass of the toner particles were mixed with each other and toner was obtained.

With respect to the obtained toner, element mapping of the toner particle surface was performed using EDX. When the total area of Al in the toner particle surface was measured and the exposed surface area of the bright pigment with respect to the surface area of the toner particle was found to be 6.6%.

Further, with respect to the toner, the charge amount was measured in the same manner as in the evaluation of the charge properties (charge amount and stabilization thereof).

As a result, the charge amount ($Q^L$) at the low temperature and low humidity was 27 (C/kg), the charge amount ($Q^H$) at the high temperature and high humidity was 17 (C/kg), and the difference ($Q^L$–$Q^H$) between the two amounts was 10 (C/kg).

From the results, according to the toner in Example 8, it is found that the charge properties (charge amount and stabilization thereof) were high and an excellent image was obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner comprising:

toner particles including particles having a flaky shape and made of bright pigment material and a binder resin coated on the surfaces of the particles; and external additive particles attached to the surfaces of the toner particles, wherein a ratio of an exposed surface area of the particles with respect to a surface area of the toner particles is greater than 0% and equal to or smaller than 20%.

2. The toner according to claim 1, wherein the ratio is equal to or smaller than 10%.

3. The toner according to claim 2, wherein the ratio is equal to or smaller than 5%.

4. The toner according to claim 1, wherein a content ratio of the particles with respect to the toner particles is equal to or greater than 5% by mass and equal to or smaller than 40% by mass.

5. The toner according to claim 4, wherein the content ratio is equal to or greater than 10% by mass and equal to or smaller than 35% by mass.

6. The toner according to claim 1, wherein resistivity of the binder resin is equal to or greater than $1.0\times10^{10}$ (Ω·cm).

7. The toner according to claim 6, wherein resistivity of the binder resin is equal to or smaller than $1.0\times10^{12}$ (Ω·cm).

8. The toner according to claim 1, wherein a volume average particle diameter of the particles is equal to or greater than 5 μm and equal to or smaller than 20 μm, and a volume average particle diameter of the toner particles is equal to or greater than 5 μm and equal to or smaller than 30 μm.

9. The toner according to claim 8, wherein the volume average particle diameter of the particles is equal to or greater than 8 μm and equal to or smaller than 20 μm, and the volume average particle diameter of the toner particles is equal to or greater than 8 μm and equal to or smaller than 25 μm.

10. A developer comprising:

carrier particles;

toner particles including particles having a flaky shape and made of bright pigment material and a binder resin coated on the surfaces of the pigment particles; and external additive particles attached to the surfaces of the toner particles, wherein a ratio of an exposed surface area of the particles with respect to a surface area of the toner particles is greater than 0% and equal to or smaller than 20%.

11. The developer according to claim 10, wherein the ratio is equal to or smaller than 10%.

12. The developer according to claim 11, wherein the ratio is equal to or smaller than 5%.

13. The developer according to claim 10, wherein a content ratio of the particles with respect to the toner particles is equal to or greater than 5% by mass and equal to or smaller than 40% by mass.

14. The developer according to claim 13, wherein the content ratio is equal to or greater than 10% by mass and equal to or smaller than 35% by mass.

15. The developer according to claim 10, wherein resistivity of the binder resin is equal to or smaller than $1.0\times10^{12}$ (Ω·cm).

16. The developer according to claim 15, wherein resistivity of the binder resin is equal to or smaller than $1.0\times10^{12}$ (Ω·cm).

17. The developer according to claim 10, wherein a volume average particle diameter of the particles is equal to or greater than 5 μm and equal to or smaller than 20 μm, and a volume average particle diameter of the toner particles is equal to or greater than 5 μm and equal to or smaller than 30 μm.

18. The developer according to claim 17, wherein the volume average particle diameter of the particles is equal to or greater than 8 μm and equal to or smaller than 20 μm, and a volume average particle diameter of the toner particles is equal to or greater than 8 μm and equal to or smaller than 25 μm.

19. A toner cartridge comprising:

a container;

toner particles contained in the container; and external additive particles attached to the surfaces of the toner particles, wherein the toner particles include particles having a flaky shape and made of bright pigment material and a binder resin coated on the surfaces of the particles, and a ratio of an exposed surface area of the particles with respect to a surface area of the toner particles is greater than 0% and equal to or smaller than 20%.

20. The toner cartridge according to claim 19, wherein resistivity of the binder resin is equal to or greater than $1.0\times10^{10}$ (Ω·cm).

* * * * *